United States Patent [19]

Stenkvist et al.

[11] 4,135,052

[45] Jan. 16, 1979

[54] DC ARC FURNACE ARC CONTROL

[75] Inventors: Sven-Einar Stenkvist; Björn Widell, both of Vesteras, Sweden

[73] Assignee: ASEA Aktiebolag, Vesteras, Sweden

[21] Appl. No.: 838,454

[22] Filed: Oct. 3, 1977

[30] Foreign Application Priority Data

Oct. 4, 1976 [SE] Sweden ..... 7610952

[51] Int. Cl.[2] ..... H05B 7/00

[52] U.S. Cl. ..... 13/11

[58] Field of Search ..... 13/9, 11, 13, 18

[56] References Cited

U.S. PATENT DOCUMENTS

| | | | |
|---|---|---|---|
| 3,371,140 | 2/1968 | Wynne | 13/9 |
| 4,016,355 | 4/1977 | Stenkvist | 13/11 |

*Primary Examiner*—R. N. Envall, Jr.

*Attorney, Agent, or Firm*—Kenyon & Kenyon, Reilly, Carr & Chapin

[57] ABSTRACT

A DC arc furnace having one or more arcing electrodes and a melt contact electrode transversely offset from the arcing electrode is provided on the outside of the furnace with control electromagnets which are supplied with DC for the purpose of keeping the arc substantially axially aligned with the arcing electrode. For more positive control of the arc direction, radiation sensing devices are provided and which are arranged to receive more or less radiation from the arc if it wanders away from its desired vertical alignment with the arcing electrode. In turn, these devices are used to control the power supplied to the control electromagnets to alter the strength of their magnetic flux, so that if it wanders from axial alignment with the arcing electrode, the arc is substantially immediately returned to that alignment.

5 Claims, 3 Drawing Figures

DC ARC FURNACE ARC CONTROL

BACKGROUND OF THE INVENTION

A DC arc furnace can have consumable arcing electrodes made of either solid graphite or of the Soderberg type. The furnace hearth which contains the melt has a melt contact electrode electrically contacted by the melt and which for practical reasons is offset in the horizontal direction from the arcing electrode which is conventionally positioned vertically through the furnace roof.

With the above construction the circuit is through the melt contact electrode, the melt, the arc, and the arcing electrode when the furnace is powered with DC. The offset position of the melt contact electrode, also called the hearth electrode, causes the arc to be directed obliquely with respect to the arcing electrode. This causes the arc flare to radiate most intensely against the furnace side wall and the furnace roof portion which are in the angular direction of the arc.

Such a DC arc furnace may use more than one arcing electrode and more than one hearth electrode. The prior art has suggested that a number of hearth electrodes be used symmetrically arranged around the arcing electrode for the purpose of balancing the electromotive forces involved to thereby keep the arc in alignment with the arcing electrode. Due to the service conditions involved a hearth electrode is expensive to construct in a furnace and it has other objectionable features. Therefore, it is desirable to use only a single hearth electrode. Varying the number of arcing electrodes is not relevant with respect to the problem under discussion.

For a smooth arc and long electrode arcing life it is usual to power such a DC arc furnace so that the melt contact or hearth electrode operates as an anode and the arcing electrode or electrodes operate cathodically.

So that only one hearth electrode can be used while the arc is held in axial alignment with the arcing electrode, the Stenkvist U.S. Pat. No. 4,016,355, dated Apr. 5, 1977, assigned to the assignee of the present invention, discloses the use of two magnetic cores forming a cross and with vertically extending pole pieces each supplied with an electric solenoid individually supplied with DC, this electromagnetic construction being positioned beneath the bottom of the furnace. The furnace bottom is made of non-magnetic materials and this electromagnetic assembly or system is positioned below the furnace bottom with its upstanding pole pieces symmetrically arranged around the vertical axis of the arcing electrode.

The disclosure of the above Stenkvist patent is by reference hereby incorporated into the present disclosure.

With the above patented arrangement the power can be supplied to the four solenoids so as to control the arc direction. The purpose is, of course, to keep the arc in vertical alignment with the arcing electrode so that the arc flare is uniformly distributed around the furnace side wall and the peripheral portion of the furnace roof to thereby distribute the erosion caused by the arc flare, uniformly throughout the furnace.

Although reasonably successful in achieving its intended purpose, the above patented arrangement has involved the problem that in practical furnace applications it has proven difficult to construct the crossed cores, pole pieces and solenoids and to power the solenoids with such precise accuracy as to make this patented concept perfectly satisfactory. Magnetic field dissemetrics around the arc are possible. Too frequently the arc when once electromagnetically aligned with the arcing electrode, becomes unstable so that the arc direction changes and assumes more or less the obliquity which produces the arc flare directed locally and intensely in the arc's angular direction against the side wall and adjacent portion of the furnace roof.

In other words, holding the arc accurately aligned with the arcing electrode of a DC arcing furnace, without using a multiplicity of melt contact or hearth electrodes, has not heretofore been solved to the fullest possible degree.

SUMMARY OF THE INVENTION

With the above in mind the present invention provides an improvement on the invention of the previously identified Stenkvist patent, with the object of keeping the arc more positively aligned with the arcing electrode in spite of magnetic dissemetries which might occur during furnace operation.

To do this the control magnets of the Stenkvist patent are used. In addition arc radiation responsive devices are grouped around the arcing electrode, up in the furnace roof in an optical arrangement causing the devices to have restricted fields of view encircling the foot of the arc when this foot is directly below and aligned with the arcing electrode. If the arc wanders from its desired vertical alignment with the arcing electrode one or another of these devices receives more or less upward radiation from the arc. The devices in turn are connected to control the DC power applied to the solenoids of the Stenkvist patent magnetic assembly. With this concept the arc can be maintained always vertically aligned with the arcing electrode because it is no longer required that the magnetic assembly be so very precisely constructed and controlled and powered. The action of the melt itself is made immaterial. Possible small inaccuracies in the manufacture of the consumable arcing electrode are no longer material.

The devices referred to may be commercially available transducers which are responsive to either light or heat or both. The arcing electrode normally extends through the furnace roof via a water cooled bushing and this bushing can be provided with vertical holes aimed appropriately to optically encompass the possible wandering path of the arc. The bushing normally has sufficient vertical extent for these holes to be long enough to restrict the fields of view of the transducers without necessarily using other focusing means necessarily located where they are exposed to the furnace heat and to the arc heat and radiation. If the transducers themselves are found to be adversely affected by such conditions, light conductors may extend from the tops of the holes to remote positions where the transducers can receive the radiation without such direct exposure to the furnace.

Transducers of the photodiode type can be used. It is easily possible to mount them in encasements which may be water cooled, for example.

Whether the transducers are mounted directly on top of the electrode bushing or at remote locations via light conductors, the radiation receiving parts at the tops of the vertical bushing holes, might become obscured, the furnace atmosphere being smokey and dusty. Such trouble is avoided by flushing the bushing or observation holes, which may be formed by separate tubes positioned in the bushing holes, by continuously downwardly flushing the observation holes or tubes with gas to prevent possible deposits on the optical surfaces of either the transducers or the light conductors. With adequate velocity the flushing gas can prevent slag splash that might possibly reach up to the electrode bushing.

In the academic sense only one radiation responsive device is conceivable and this might even be a practical solution if the arc tends to flip in the same angular direction. For practical reasons three or four of the devices symmetrically placed around the electrode axis is preferred, each device having a restricted field of view symmetrically arranged around the electrode tip and preferably with the fields of view overlapping slightly.

For other purposes the prior art has used such radiation responsive devices and is familiar with the way that the response of the devices can be amplified by suitable amplifiers and used to control high-power electric currents. This prior art knowledge can be used in connection with the practical design for commercial use of this invention.

DESCRIPTION OF THE DRAWINGS

The present invention is entirely schematically illustrated by the accompanying drawings in which.

DETAILED DESCRIPTION

Figure 1:
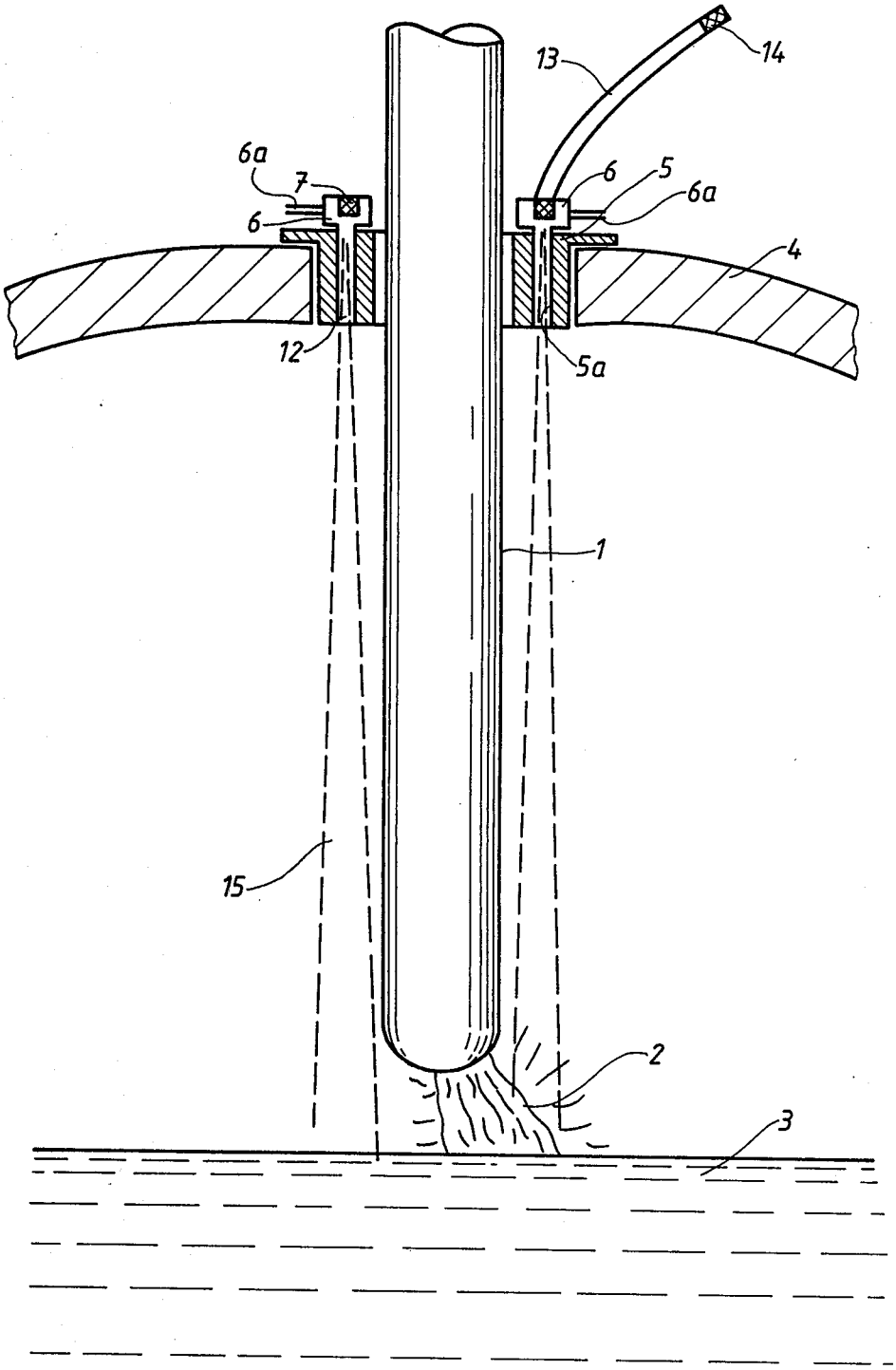
FIG. 1 shows in vertical section the elements of this invention as they would be applied to improve the invention of the previously referred to Stenkvist patents.

Referring to the above drawings, in FIG. 1 the consumable graphite electrode 1 is shown with its arc 2 formed at an oblique angle in a right-hand direction. The necessary and the normally horizontally offset melt contact or hearth electrode is not shown but its position can be seen from the drawings of the Stenkvist patent. Assuming the melt contact is offset in the right-hand direction relative to FIG. 1, the angularity of the arc 2 would be as indicated by FIG. 1 in the absence of corrective measures.

The side wall lining of the furnace is not shown because its construction is so well known, but the furnace roof is indicated at 4 with its water cooled bushing 5 through which the arcing electrode 1 extends downwardly with its tip spaced above the melt 3.

Figure 3:
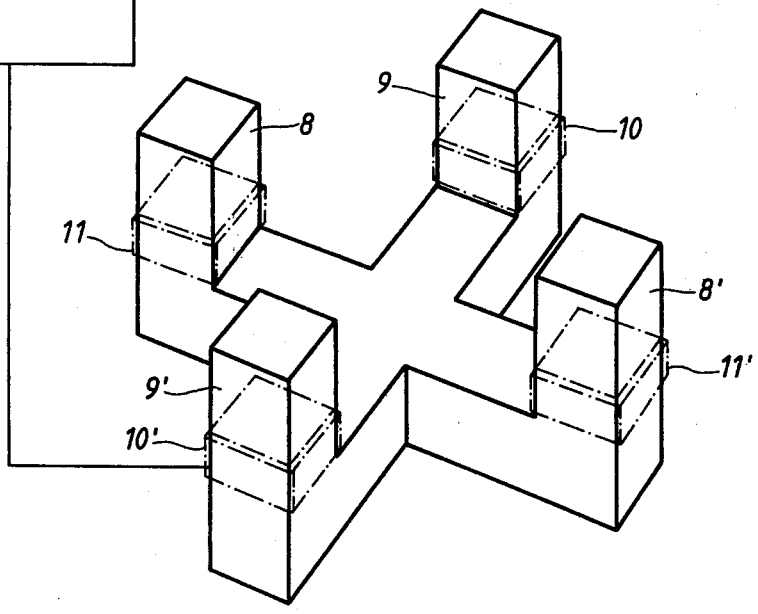
FIG. 3 substantially duplicates FIG. 4 of that Stenkvist patent.

FIG. 3 shows the electromagnetic structure of the Stenkvist patent with its crossed cores from which the pole pieces 8 and 8′ and 9 and 9′ extend upwardly beneath the non-magnetic hearth and furnace bottom (not illustrated). The energizing DC powered electric solenoids are indicated at 10 and 10′ and 11 and 11′. The center line of this magnetic structure below the hearth is positioned on the center line of the electrode 1, and if the crossed cores, their pole pieces and four solenoids, the electric powering system, the conditions within the melt 3 and any other possible variables, are precisely designed, constructed and operated exactly and precisely, the arc 2 should be axially aligned with the axis of the vertical electrode 1. Such procedures of construction and operation cannot be achieved completely in the case of a furnace of commercial size and operating under commercial production conditions.

As previously indicated with the present invention arc radiation responsive devices are used to positively control the direction of the arc 2.

Referring again to FIG. 1 the bushing 5 is shown as provided with axially extending holes 5*a* which extend vertically through the full vertical thickness of the bushing 5. Preferably these holes are clustered symmetrically about the electrode 1 and preferably three, four or more of these holes are provided. Although not illustrated, these holes may be in effect lined by more optically precise tubes. At the top of each hole a casing 6 is provided having gas flow inlets 6*a* so that the downward flows of gas can be forced downwardly through the tubes 5*a* at adequate velocity to keep at least the lengths of the tubes free from smoke and fumes and possibly splashed slag. The gas may be compressed nitrogen but because the gas flows required are small in volume relative to the inside volume of the furnace, compressed air may also be used.

In FIG. 1 the tube on the left-hand side, which may be one of four, is shown as having the arc radiation responsive device 7 positioned directly in the casing 6 at the top of that hole 5*a*. On the right-hand side the casing 6 is shown as having the bottom end of a light transmitting tube 13 fixed in optical alignment with that one of the holes 5*a* and with the responsive device 14 at the outer end of this light conductor 13. This conductor may be of the glass fiber type having flexibility so that removal of a furnace roof 4 for furnace charging, for example, does not require disconnection of the light conductor 33.

All of the casings 6 may have the radiation responsive devices positioned directly in them, possibly with the provision of water cooling, and all of them may, as an alternative, use the light conductors 13.

Figure 2:
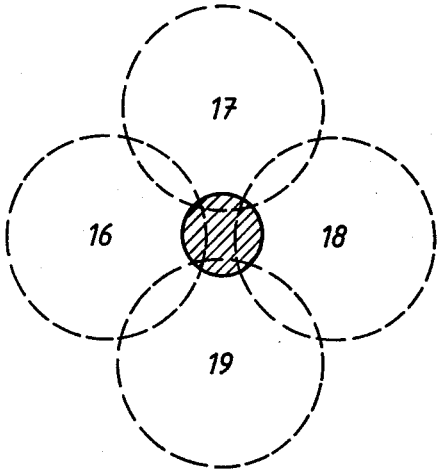
FIG. 2 shows the manner in which the transducer fields of view can be arranged around the arcing electrode tip.
Figure 2:
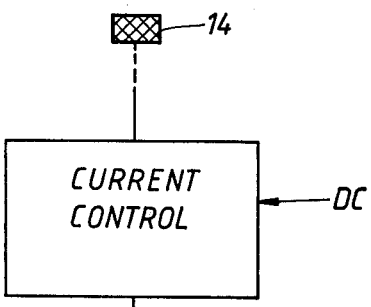

The length of the holes 5*a*, or tubes, should be such as to restrict the fields of view of the responsive devices, or the receiving ends of the light conductors when used, to relatively narrow cones as indicated by dashed lines at 15 in FIG. 1. FIG. 2 shows how in the case of four radiation responsive devices, the fields of view can be made to slightly overlap, the four fields viewed by the four radiation responsive devices being indicated at 16 through 19.

In FIG. 1 it can be seen that the right-hand one of the conical fields of vision of that one of the heat or light responsive devices is picking up the radiation from the arc 2 which has wandered in the right-hand direction. The left-hand one of the devices in FIG. 1 can see very little or nothing at that time that is equivalent to the arc radiation. As previously indicated the devices 7 may be light responsive photodiodes and FIG. 3 illustrates schematically how any such transducer can make responsive to its responses a current control supplied with DC and operating in accordance with prior art principles, so as to, in each instance, control the power supplied to the solenoid. Each solenoid can be controlled individually by its own transducer.

Even though each transducer has a narrow field of view fixed with precision so as to symmetrically surround the arcing electrode tip, variations might occur because of the fumes of varying translucency which fill the furnace when it is operating. To avoid the variations in the density of the furnace atmosphere influencing the precise control of the arc position, combinations of signals from diametrically opposite transducers can be formed. If the signals form two such transducers are designated $S_1$ and $S_2$ the following combination, for example, is formed:

$$S_1/S_2 \text{ or } (S_1 + S_2)/(S_1 - S_2)$$

and this combined signal then controls the position of the arc by way of the control magnets.

The use of light conductors as shown at 13 is recommended. They not only permit remote positioning of the devices or transducers relative to the heat and fumes, but also they permit the location of the transducers far enough away from the strong and varying magnetic fields created by the current carried by the electrode and its external conductors, to avoid these fields from affecting the transducers or devices or sensers in the event they are sensitive to such magnetic fields.

What is claimed is:

1. A DC arc furnace control comprising a furnace having a hearth for containing a melt, an arcing electrode positioned above the melt for forming an arc with the melt when placed in circuit therewith, and magnetic means for applying a magnetic field to the arc so as to control the arcing direction; wherein the improvement comprises optical means for optically detecting angular reflections of said arc, for controlling said magnetic means and said furnace has a roof through which said electrode depends and said optical means comprises at least one arc radiation responsive device receiving arc radiation at a position adjacent to said roof and beside said electrode and having means for restricting the field of view of the device to an area adjacent to the electrode's tip.

2. The control of claim 1 in which a light conductor has a receiving end at said position and the conductor extends from said position to a more remote position, said device receiving arc radiation via said conductor.

3. The control of claim 1 in which a member forms a substantially vertical hole of a length forming said means for restricting said field of view, said device receiving said radiation via the upper end portion of the hole.

4. The control of claim 1 in which a plurality of said devices are symmetrically arranged around said electrode and the field restricting means provides the devices with at least slightly overlapping fields of view symmetrically arranged around the electrode's tip.

5. The control of claim 3 having means for downwardly flushing said hole with gas.

* * * * *